US006147048A

United States Patent [19]

Huff et al.

[11] Patent Number: 6,147,048

[45] Date of Patent: Nov. 14, 2000

[54] USE OF AT LEAST TRIVALENT ALCOHOLS AND THEIR ALKOXYLATION PRODUCTS INCREASING THE SPEED OF DISSOLUTION OF PARTICULATE DETERGENT FORMULATIONS IN WATER

[75] Inventors: Jürgen Huff, Bissersheim; Hans-Ulrich Jäger, Neustadt; Martin aus dem Kahmen, Ludwigshafen; Matthias Kroner, Eisenberg; Jürgen Alfred Lux, Niederkirchen; Günter Oetter, Frankenthal, all of Germany

[73] Assignee: BASF Aktiengesellschaft, Ludwigshafen, Germany

[21] Appl. No.: 09/147,281

[22] PCT Filed: May 21, 1997

[86] PCT No.: PCT/EP97/02590

§ 371 Date: Nov. 19, 1998

§ 102(e) Date: Nov. 19, 1998

[87] PCT Pub. No.: WO97/44426

PCT Pub. Date: Nov. 27, 1997

[30] Foreign Application Priority Data

May 22, 1996 [DE] Germany ..... 196 20 364

[51] Int. Cl.[7] ..... C11D 3/00; C11D 3/37

[52] U.S. Cl. ..... 510/438; 510/443; 510/475; 510/505

[58] Field of Search ..... 510/228, 220, 510/226, 224, 376, 221, 506, 230, 378, 467, 476; 134/25.2; 252/186.38; 8/137

[56] References Cited

FOREIGN PATENT DOCUMENTS

| | | |
|---|---|---|
| 0 080 222 | 6/1983 | European Pat. Off. . |
| 41 24 701 | 1/1993 | Germany . |
| WO 96/29389 | 9/1996 | WIPO . |

OTHER PUBLICATIONS

Derwent Abstracts, AN 96–236357/24, JP 8–092591, Apr. 9, 1996.

Derwent Abstracts, AN 86–314279/48, JP 61–231099, Oct. 15, 1986.

Derwent Abstracts, AN 90–227943/30, JP 2–155928, Jun. 15, 1990.

*Primary Examiner*—Yogendra Gupta
*Assistant Examiner*—Gregory Webb
*Attorney, Agent, or Firm*—Oblon, Spivak, McClelland, Maier & Neustadt, P.C.

[57] ABSTRACT

The use of at least trihydric alcohols and their reaction products with ethylene oxide and/or propylene oxide as additive to particulate detergent formulations, especially compact detergents, to increase their rate of dissolving in water in amounts of from 0.1 to 5% by weight based on the detergent formulations.

7 Claims, No Drawings

USE OF AT LEAST TRIVALENT ALCOHOLS AND THEIR ALKOXYLATION PRODUCTS INCREASING THE SPEED OF DISSOLUTION OF PARTICULATE DETERGENT FORMULATIONS IN WATER

BACKGROUND OF THE INVENTION

1. Field of the Invention

The invention relates to the use of at least trihydric alcohols and their reaction products with ethylene oxide and/or propylene oxide as additive to particulate detergent formulations to increase their rate of dissolving in water in amounts of from 0.1 to 5% by weight based on the detergent formulations.

2. Description of the Background

Particulate detergents are intended, on introduction into water, to disintegrate as quickly as possible into-the individual ingredients in order to form the wash liquor ready for use. The rate of dissolving of some particulate detergent formulations, in particular compact detergents which have, for example, an apparent density of at least 550 g/l, on mixing with water is, however, still in need of improvement.

It is an object of the present invention to provide a detergent additive which results in an increase in the rate of dissolving of particulate detergents in water.

SUMMARY OF THE INVENTION

We have found that this object is achieved by the use of reaction products of at least trihydric alcohols with ethylene oxide and/or propylene oxide as additive to particulate detergent formulations to increase their rate of dissolving in water in amounts of from 0.1 to 5% by weight based on the detergent formulations.

DETAILED DESCRIPTION OF THE INVENTION

Examples of suitable at least trihydric alcohols are glycerol, diglycerol, triglycerol, tetraglycerol, pentaglycerol, hexaglycerol, heptaglycerol and octaglycerol, pentaerythritol, trimethylolpropane, erythritol, mannitol, sorbitol, sucrose, glucose and polyvinyl alcohols with molecular weights of up to 20,000. In place of the individual compounds it is also possible to employ mixtures of said compounds. Of particular industrial interest is, for example, the use of hydrogenated starch hydrolyzates or hydrogenated glucose syrups. It is possible to employ, for example, commercially available hydrogenated starch hydrolyzates supplied by Cerestar under the trade names SORBIDEX 200 and SORBIDEX 122.

Particularly effective products for increasing the rate of dissolving of particulate detergent formulations are reaction products of at least trihydric alcohols with ethylene oxide and/or propylene oxide. These reaction products and processes for their preparation form part of the prior art. Thus, for example, reaction of glycerol, erythritol, pentaerythritol, trimethylolpropane, mannitol or sorbitol with ethylene oxide and/or propylene oxide in the presence of conventional alkoxylation catalysts such as KOH, NaOH, Ca hydroxide, Ca oxide or supported catalysts results in detergent additives which considerably increase the rate of dissolving of detergent formulations in water compared with polyethylene glycol. The alkoxylated products may have a wide or a narrow molecular weight distribution. Of particular importance in this connection are the reaction products of glycerol, erythritol, pentaerythritol, trimethylolpropane, mannitol or sorbitol with ethylene oxide. For example, 1 mol of an at least trihydric alcohol is reacted with 1 to 100 mol of ethylene oxide. These products can be modified by allowing them to react further where appropriate with up to 20 mol of propylene oxide. However, the procedure for preparing modified ethylene oxide adducts can be such that a mixture of ethylene oxide and propylene oxide gases is allowed to act on the at least trihydric alcohols. Another possible variation comprises reacting said alcohols initially with propylene oxide and subsequently with ethylene oxide. Propylene oxide is preferably employed in an amount of from 1 to 15 mol per mole of alcohol. Reaction products of 1 mol of trimethylolpropane with 1 to 100 mol of ethylene oxide are particularly preferably employed, with reaction products of 1 mol of trimethylolpropane with 3 to 30 mol of ethylene oxide mostly being used.

Also suitable as detergent additive which increases the rate of dissolving of detergent formulations in water are ethoxylated hydrogenated sugars such as sorbitol or mannitol, and ethoxylated polyvinyl alcohol. The additives to be used according to the invention are present in the detergent formulation in amounts of from 0.1 to 5, preferably 0.5 to 2,% by weight. They are preferably mixed as homogeneously as possible with the other detergent ingredients. However, they can also be applied to the surface of the fine-particle detergent formulations and allowed to diffuse in.

The detergents can be in powder form or in the form of granules, flakes, pellets, beads, plates or tablets. The average particle diameter of the particulate detergent formulations is, for example, 200 $\mu$m to 5 mm and is preferably in the range from 1 to 3 mm. However, the detergent formulations can also be portioned in such a way that only one bead or one tablet is necessary for one wash in a washing machine. Beads or tablets of this type then have a far larger average particle diameter than indicated above. The advantage of such relatively large-volume particles is that dosage is easy.

The detergents may be heavy duty detergents or speciality detergents. Suitable surfactants are both anionic and nonionic or mixtures of anionic and nonionic surfactants. The surfactant content of the detergents is preferably 8 to 30% by weight.

Examples of suitable anionic surfactants are fatty alcohol sulfates from fatty alcohols with 8 to 22, preferably 10 to 18, carbon atoms, e.g. $C_9$–$C_{11}$-alcohol sulfates, $C_{12}$–$C_{13}$-alcohol sulfates, cetyl sulfate, myristyl sulfate, palmityl sulfate, stearyl sulfate and tallow fatty alcohol sulfate.

Other suitable anionic surfactants are sulfated, ethoxylated $C_8$–$C_{22}$-alcohols and their soluble salts. Compounds of this type are prepared, for example, by initially alkoxylating a $C_8$–$C_{22}$-, preferably a $C_{10}$–$Cl_8$-, alcohol and subsequently sulfating the alkoxylation product. Ethylene oxide is preferably used for the alkoxylation, employing 2 to 50, preferably 3 to 20, mol of ethylene oxide per mole of fatty alcohol. However, the alcohols can also be alkoxylated with propylene oxide, alone or with butylene oxide. Also suitable are those alkoxylated $C_8$–$C_{22}$-alcohols which contain ethylene oxide and propylene oxide or ethylene oxide and butylene oxide. The alkoxylated $C_8$–$C_{22}$-alcohols may contain the ethylene oxide, propylene oxide and butylene oxide units in the form of blocks or in random distribution.

Other suitable anionic surfactants are alkylsulfonates such as $C_8$–$C_{24}$-, preferably $C_{10}$–$C_{18}$-, alkanesulfonates, and soaps such as the salts of $C_8$–$C_{24}$-carboxylic acids. Other suitable anionic surfactants are linear $C_9$–$C_{20}$-alkylbenzenesulfonates (LAS). The polymers according to the invention are preferably employed in detergent formulations with an LAS content of less than 4%, particularly preferably in LAS-free formulations.

The anionic surfactants are added to the detergent preferably in the form of salts. Suitable cations in these salts are alkali metal ions such as sodium, potassium, lithium and ammonium ions, e.g. hydroxyethylammonium, di(hydroxyethyl)ammonium and tri(hydroxyethyl) ammonium ions.

Examples of suitable nonionic surfactants are alkoxylated $C_8$–$C_{22}$-alcohols. The alkoxylation can be carried out with ethylene oxide, propylene oxide and/or butylene oxide. It is possible to employ as surfactant in this case all alkoxylated alcohols which contain at least two molecules of an above-mentioned alkylene oxide in the adduct. Also suitable in this connection are block copolymers of ethylene oxide, propylene oxide and/or butylene oxide, or adducts which contain said alkylene oxides in random distribution. 2 to 5, preferably 3 to 20, mol of at least one alkylene oxide are employed per mole of alcohol. Ethylene oxide is preferably employed as alkylene oxide. The alcohols preferably have 10 to 18 carbon atoms.

Another class of nonionic surfactants comprises alkyl polyglucosides with 8 to 22, preferably 10 to 18, carbon atoms in the alkyl chain. These compounds contain 1 to 20, preferably 1.1 to 5, glucoside units.

Another class of nonionic surfactants comprises N-alkylglucamides of the general structure I or II

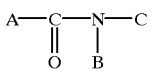

(I)

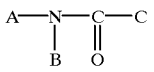

(II)

where A is $C_6$–$C_{22}$-alkyl, B is H or $C_1$–$C_4$-alkyl and C is a polyhydroxyalkyl radical with 5 to 12 carbon atoms and at least 3 hydroxyl groups. A is preferably $C_{10}$–$C_{18}$-alkyl, B is preferably $CH_3$ and C is preferably a $C_5$ or $C_6$ radical. Compounds of this type are obtained, for example, by acylation of reductively aminated sugars with chlorides of $C_{10}$–$C_{18}$-carboxylic acids. The detergent formulations preferably contain $C_{10}$–$C_{16}$-alcohols ethoxylated with 3–12 mol of ethylene oxide, particularly preferably ethoxylated fatty alcohols, as nonionic surfactants.

Other suitable and preferred surfactants are the endgroup-capped fatty amide alkoxylates, which are disclosed in WO-A-95/11225, of the general formula $$R^1—CO—NH—(CH_2)_n—O—(AO)_x—R^2 \quad \text{(III)},$$

where $R^1$ is $C_5$–$C_{21}$-alkyl or -alkenyl, $R^2$ is $C_1$–$C_4$-alkyl,

A is $C_2$–$C_4$-alkylene, n is 2 or 3, and x has a value from 1 to 6.

Examples of such compounds are the reaction products of n-butyltriglycolamine of the formula $H_2N—(CH_2—CH_2—O)_3—C_4H_9$ with methyl dodecanoate or the reaction products of ethyltetraglycolamine of the formula $H_2N—(CH_2—CH_2—O)_4—C_2H_5$ with a commercial mixture of saturated $C_8$–$C_{18}$ fatty acid methyl esters.

The detergents in powder or granule form additionally contain one or more inorganic builders. Suitable inorganic builders are all conventional inorganic builders such as alumosilicates, silicates, carbonates and phosphates. Examples of suitable inorganic builders are alumosilicates with ion-exchanging properties such as zeolites. Various types of zeolites are suitable, in particular zeolites A, X, B, P, MAP and HS in their Na form or in forms in which Na is partly replaced by other cations such as Li, K, Ca, Mg or ammonium. Suitable zeolites are described, for example, in EP-A-0 038 591, EP-A-0 021 491, EP-A-0 087 035, U.S. Pat. No. 4,604,224, GB-A-2 013 259, EP-A-0 522 726, EP-A-0 384 070A and WO-A-94/24251.

Other suitable inorganic builders are, for example, amorphous or crystalline silicates such as amorphous disilicates, crystalline disilicates such as the sheet silicate SKS-6 (manufactured by Hoechst AG). The silicates can be employed in the form of their alkali metal, alkaline earth metal or ammonium salts. Na, Li and Mg silicates are preferably employed.

Other suitable inorganic builders are carbonates and bicarbonates. These can be employed in the form of their alkali metal, alkaline earth metal or ammonium salts. Na, Li and Mg carbonates and bicarbonates, in particular sodium carbonate and/or sodium bicarbonate, are preferably employed.

The inorganic builders can be present in the detergents in amounts of from 0 to 60% by weight together with organic cobuilders to be used where appropriate. The inorganic builders can be incorporated into the detergent either alone or in any combination with one another. They are added to detergents in powder or granule form in amounts of from 10 to 60% by weight, preferably in amounts of from 20 to 50% by weight.

Detergent formulations in powder or granule form or other solid formulations contain organic cobuilders in amounts of from 0.1 to 20% by weight, preferably in amounts of from 1 to 15% by weight, together with inorganic builders. The heavy duty 10 detergents in powder or granule form may additionally contain as other conventional ingredients a bleach system consisting of at least one bleach, where appropriate combined with a bleach activator and/or a bleach catalyst.

Suitable bleaches are perborates and percarbonates in the form of their alkali metal, in particular their Na, salts. They are present in the formulations in amounts of from 5 to 30% by weight, preferably 10 to 25% by weight. Other suitable bleaches are inorganic and organic peracids in the form of their alkali metal or magnesium salts or partly also in the form of the free acids. Examples of suitable organic peracids and salts thereof are Mg monoterephthalate, phthalimidopercaproic acid and diperdodecanedioic acid. An example of an inorganic peracid salt is potassium peroxomonosulfate (Oxon).

Examples of suitable bleach activators are acylamine such as tetraacetylethylenediamine, tetraacetylglycoluril, N,N'-diacetyl-N,N'-dimethylurea and 1,5-diacetyl-2,4-dioxohexahydro-1,3,5-triazine acylated lactams such as acetylcaprolactam, octanoylcaprolactam and benzoylcaprolactam substituted phenol esters of carboxylic acids such as Na acetoxybenzenesulfonate, Na octanoyloxybenzenesulfonate and Na nonanoyloxybenzenesulfonate acylated sugars such as pentaacetylglucose anthranil derivatives such as 2-methylanthranil or 2-phenylanthranil enol esters such as isopropenyl acetate oxime esters such as acetone 0-acetyloxime carboxylic anhydrides such as phthalic anhydride or acetic anhydride.

Tetraacetylethylenediamine and Na nonanoyloxybenzenesulfonates are preferably employed as bleach activators. The bleach activators are added to heavy duty detergents in amounts of from 0.1 to 15% by weight, preferably in amounts of from 1.0 to 8.0% by weight, particularly preferably in amounts of from 1.5 to 6.0% by weight.

Suitable bleach catalysts are quaternized imines and sulfone imines as described in U.S. Pat. No. 5,360,568, U.S. Pat. No. 5,360,569 and EP-A-0 453 003, and Mn complexes, cf., for example, WO-A-94/21777. If bleach catalysts are employed in the detergent formulations, they are present therein in amounts of up to 1.5% by weight, preferably up to 0.5% by weight, and in the case of the very active manganese complexes in amounts of up to 0.1% by weight.

The detergents preferably contain an enzyme system. This comprises proteases, lipases, amylases and cellulases normally employed in detergents. The enzyme system may be restricted to a single one of the enzymes or contain a combination of different enzymes. The amounts of commercial enzymes added to the detergents are, as a rule, from 0.1 to 1.5% by weight, preferably 0.2 to 1.0% by weight of the formulated enzyme. Examples of suitable proteases are Savinase and Esperase (manufactured by Novo Nordisk). An example of a suitable lipase is Lipolase (manufactured by Novo Nordisk). An example of a suitable cellulase is Celluzym (manufactured by Novo Nordisk).

The detergents preferably contain as other conventional ingredients soil release polymers and/or antiredeposition agents. These are, for example, polyesters from polyethylene oxides with ethylene glycol and/or propylene glycol and aromatic dicarboxylic acids or aromatic and aliphatic dicarboxylic acids. Polyesters from polyethylene oxides which are endgroup-capped at one end with di- and/or polyhydric alcohols and dicarboxylic acids. Polyesters of these types are known, cf., for example, U.S. Pat. No. 3,557,039, GB-A-1 154 730, EP-A-0 185 427, EP-A-0 241 984, EP-A-0 241 985, EP-A-0 272 033 and U.S. Pat. No. 5,142,020.

Other suitable soil release polymers are amphiphilic graft or other copolymers of vinyl and/or acrylic esters on polyalkylene oxides, cf. U.S. Pat. No. 4,746,456, U.S. Pat. No. 4,846,995, DE-A-3 711 299, U.S. Pat. No. 4,904,408, U.S. Pat. No. 4,846,994 and U.S. Pat. No. 4,849,126 or modified celluloses such as methylcellulose, hydroxypropylcellulose or carboxymethylcellulose.

Antiredeposition agents and soil release polymers are present in the detergent formulations in amounts of 0 to 2.5% by weight, preferably 0.2 to 1.5% by weight, particularly preferably 0.3 to 1.2% by weight. Soil release polymers which are preferably employed are the graft copolymers, disclosed in U.S. Pat. No. 4,746,456, of vinyl acetate on polyethylene oxide of molecular weight 2500–8000 in the ratio 1.2:1 to 3.0:1 by weight, and commercial polyethylene terephthalate/polyoxyethylene terephthalates of molecular weight 3000 to 25000 from polyethylene oxides of molecular weight 750 to 5000 with terephthalic acid and ethylene oxide and a molar ratio of polyethylene terephthalate to polyoxyethylene terephthalate of 8:1 to 1:1, and the block polycondensates, disclosed in DE-A-4 403 866, which contain blocks of (a) ester units from polyalkylene glycols with a molecular weight of 500 to 7500 and aliphatic dicarboxylic acids and/or monohydroxy carboxylic acids and (b) ester units from aromatic dicarboxylic acids and polyhydric alcohols. These amphiphilic block copolymers have molecular weights of from 1500 to 25000.

A typical heavy duty detergent in powder or granule form can have the following composition, for example:

3–50, preferably 8–30,% by weight of at least one anionic and/or nonionic surfactant, 5–50, preferably 15–42.5, % by weight of at least one inorganic builder, 5–30, preferably 10–25, % by weight of an inorganic bleach, 0.1–15, preferably 1–8, % by weight of a bleach activator, 0–1, preferably up to a maximum of 0.5, % by weight of a bleach catalyst, 0.05–5% by weight, preferably 0.2–2.5% by weight, of a color transfer inhibitor based on water-soluble homopolymers of N-vinylpyrrolidone or N-vinylimidazole, water-soluble copolymers of N-vinylimidazole and N-vinylpyrrolidone, crosslinked copolymers of N-vinylimidazole and N-vinylpyrrolidone with a particle size of from 0.1 to 500, preferably up to 250, $\mu$m, these copolymers containing 0.01 to 5, preferably 0.1 to 2, % by weight of N,N'-divinylethyleneurea as crosslinker. Other color transfer inhibitors are water-soluble and crosslinked polymers of 4-vinylpyridine N-oxide obtainable by polymerizing 4-vinylpyridine and subsequently oxidizing the polymers, 0.1–20, preferably 1–15, % by weight of at least one modified polyaspartic acid to be used according to the invention as organic cobuilder, 0.2–1.0% by weight of protease, 0.2–1.0% by weight of lipase, 0.3–1.5% by weight of a soil release polymer.

A bleach system is often entirely or partly dispensed with within mild speciality detergents (for example in color detergents). A typical color detergent in powder or granule form may, for example, have the following composition:

3–50, preferably 8–30, % by weight of at least one anionic and/or nonionic surfactant, 10–60, preferably 20–55, % by weight of at least one inorganic builder, 0–15, preferably 0–5, % by weight of an inorganic bleach, 0.05–5% by weight, preferably 0.2–2.5, % by weight of a color transfer inhibitor, cf. above, 0.1–20, preferably 1–15, % by weight of at least one modified polyaspartic acid described above as organic cobuilder, 0.2–1.0% by weight of protease, 0.2–1.0% by weight of cellulase, 0.2–1.5% by weight of a soil release polymer, e.g. a graft copolymer of vinyl acetate on polyethylene glycol.

The detergents in powder or granule form can contain as other conventional ingredients up to 60% by weight of inorganic fillers. Sodium sulfate is normally used for this purpose. However, the detergents preferably have a low filler content, i.e. they contain up to 20% by weight, particularly preferably up to 8% by weight, of fillers. The detergents may have apparent densities varying in the range from 300 to 1000 g/l. Modern compact detergents as a rule have high apparent densities, e.g. 550 to 1000 g/l, and a granular structure.

The detergents may, where appropriate, contain other conventional additives. Other additives which may be present where appropriate are, for example, complexing agents, phosphonates, optical brighteners, dyes, perfume oils, foam suppressants and corrosion inhibitors. They may additionally contain up to 20% by weight of water.

EXAMPLE 1

25 g of commercial Persil® Megaperls are stirred with 3.5 g of water at 60° C. to give a paste and intimately mixed with 0.5 g of an adduct of 10 mol of ethylene oxide and 1 mol of trimethylolpropane. A bead is formed from 1.00 g of the paste obtainable in this way. The time necessary for complete disintegration of the bead into the individual ingredients to form a wash liquor is then determined by stirring the bead in 500 ml of water at 30° C. using a magnetic stirrer at 500 rpm. The bead had completely disintegrated into the individual ingredients to form a wash liquor after 27 min.

EXAMPLE 2

Example 1 is repeated with the sole exception that the adduct of 30 mol of ethylene oxide and 1 mol of trimethylolpropane is employed as agent to increase the rate of dissolving. After the bead formed from the mixture had been stirred at 500 rpm in 500 ml of water at 30° C. for 29 minutes the bead had completely disintegrated into the individual ingredients to form a wash liquor.

COMPARATIVE EXAMPLE 1

25 g of commercial Persil® Megaperls are stirred with 3.5 g of water at 60° C. to give a paste. A bead is formed from 1.00 g of this mixture and then the time necessary for complete disintegration of the bead into the individual ingredients to form a wash liquor is determined as indicated in Example 1. 35 min was required for this.

COMPARATIVE EXAMPLES 2 to 6

The procedure is as described in Example 1 but, in place of the adduct of ethylene oxide and trimethylolpropane employed therein, the ethylene oxide derivatives indicated in the table are used.

The time necessary for complete disintegration of the bead into the individual ingredients to form a wash liquor is likewise indicated in the table.

TABLE

| Comparative Example | Ethylene oxide derivative | Molecular weight $M_N$ | Time [min] for complete disintegration of the bead formed from the mixture |
|---|---|---|---|
| 2 | Polyethylene glycol | 300 | 31 |
| 3 | Polyethylene glycol | 600 | 32 |
| 4 | Polyethylene glycol | 1500 | 34 |
| 5 | Polyethylene glycol | 4000 | 32 |
| 6 | Adduct of 34 mol ethylene oxide and 1 mol $C_{13}/C_{15}$ alcohol | | 34 |

We claim:

1. A particulate detergent formulation which contains from 0.1 to 5% by weight of a reaction product of 1 mol of at least one polyhydric alcohol containing at least three hydroxyl groups with 1 to 100 mol of ethylene oxide and optionally, with up to 20 mol of propylene oxide, wherein the reaction product increases the rate of dissolution of the formulation in water.

2. The particulate detergent formulation as claimed in claim 1 wherein the polyhydric alcohol comprises glycerol, erythritol, pentaerythritol, trimethylolpropane, mannitol or sorbitol.

3. The particulate detergent formulation as claimed in claim 1, wherein the reaction product comprises the reaction product of 1 mol of trimethylolpropane with 1 to 100 mol of ethylene oxide.

4. The particulate detergent formulation as claimed in claim 1, wherein the reaction product comprises the reaction product of 1 mol of trimethylolpropane with 3 to 30 mol of ethylene oxide.

5. The particulate detergent formulation as claimed in claim 1, comprising 0.5 to 2.5% by weight, based on the weight of the detergent formulation, of the reaction products.

6. The particulate detergent formulation as claimed in claim 1, having an apparent density of from 550 to 1000 g/l.

7. The particulate detergent formulation as claimed in claim 1, having an apparent density of at least 700 g/l.

* * * * *